United States Patent [19]

Windhösel et al.

[11] Patent Number: 4,986,488

[45] Date of Patent: Jan. 22, 1991

[54] COMPRESSIBLE CHEESE CENTER FOR DYEING PURPOSES

[75] Inventors: Ralf Windhösel, Sonnenbühl/Württ; Michael H. Wendler, Reutlingen/Württ, both of Fed. Rep. of Germany

[73] Assignee: Emil Adolff Plastic GmbH, Fed. Rep. of Germany

[21] Appl. No.: 457,505

[22] Filed: Dec. 27, 1989

[30] Foreign Application Priority Data

Dec. 27, 1988 [DE] Fed. Rep. of Germany ..... 3844006

[51] Int. Cl.[5] ..... B65H 75/20; B65H 75/24

[52] U.S. Cl. ..... 242/118.1; 242/118.11

[58] Field of Search ..... 242/118.1, 118.11, 118, 242/118.2, 118.3, 118.31, 118.32; 68/189, 198

[56] References Cited

U.S. PATENT DOCUMENTS

| | | | |
|---|---|---|---|
| 3,465,984 | 9/1969 | Tigges et al. | 242/118.11 |
| 3,753,534 | 8/1973 | Ono et al. | 242/118.11 |
| 3,827,652 | 8/1974 | Burchette, Jr. | 242/118.11 |
| 4,181,274 | 1/1980 | Burchette, Jr. | 242/118.11 |
| 4,379,529 | 4/1983 | Nielsen | 242/118.11 |
| 4,454,734 | 6/1984 | Marquis et al. | 242/118.11 X |
| 4,789,111 | 12/1988 | Thomas et al. | 242/118.1 |
| 4,872,621 | 10/1989 | Thomas | 242/118.11 |
| 4,941,621 | 7/1990 | Pasini | 242/118.1 |

FOREIGN PATENT DOCUMENTS

| | | |
|---|---|---|
| 0257268 | 7/1987 | European Pat. Off. . |
| 6601274 | 7/1967 | Fed. Rep. of Germany . |
| 2062520 | 7/1971 | Fed. Rep. of Germany . |
| 1936352 | 11/1971 | Fed. Rep. of Germany . |
| 7442234 | 4/1975 | Fed. Rep. of Germany . |
| 7516449 | 9/1975 | Fed. Rep. of Germany . |
| 8416028 | 5/1984 | Fed. Rep. of Germany . |

*Primary Examiner*—Stanley N. Gilreath
*Attorney, Agent, or Firm*—Wigman & Cohen

[57] ABSTRACT

A compressible cheese center for dyeing purposes, has two end rings, and a plurality of intermediate stiffening rings (12, 14 and 16) connected together by springy webs (18).

Spacer lugs (34) are arranged pairwise between webs (18) which are adjacent to one another in the circumferential direction of the cheese center so that the lugs (34) of each pair meet when they approach one another in the axial direction, preventing parts of the web from abutting against the adjacent ring when compression is too high. Such abutment could cause breakage of the web as well as clamping of the fibres or threads.

21 Claims, 2 Drawing Sheets

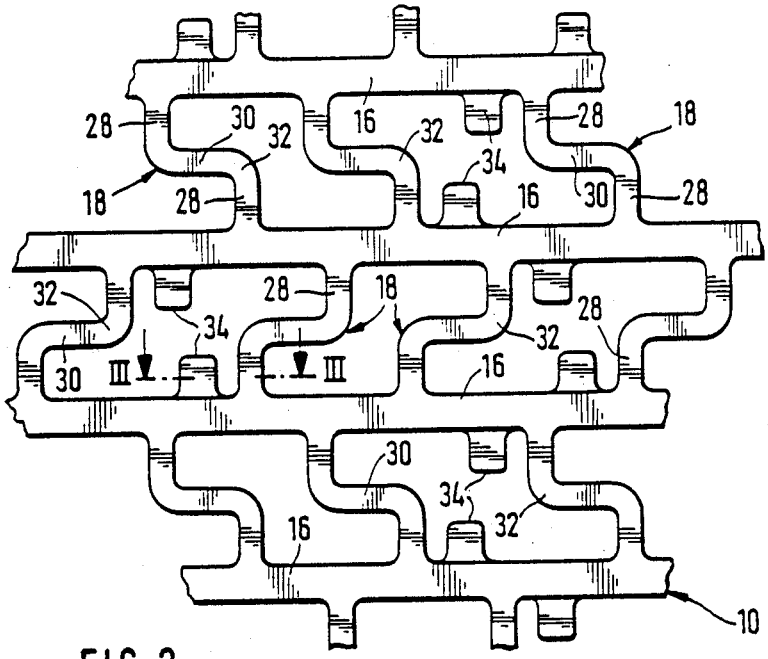
FIG. 2
FIG. 3
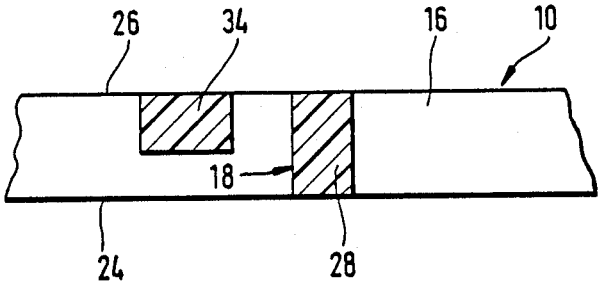

COMPRESSIBLE CHEESE CENTER FOR DYEING PURPOSES

BACKGROUND OF THE INVENTION

1. Field of the Invention

This invention relates to a cylindrical, axially compressible cheese center or centre for dyeing a package of yarn or textile thread wound on the center, and more particularly to such a cheese center having two end rings between which are arranged several stiffening rings in axial succession, each of which stiffening rings is firmly connected to an adjacent stiffening ring and to an end ring or to another adjacent stiffening ring by means of a plurality of springy webs. The cheese center has ring connecting webs which are bent at right angles and joined to the rings at right angles, the external surfaces of all the webs and of the stiffening rings and of the sections by which the webs being connected to the end rings forming a cylindrical envelope.

2. Description of the Prior Art

In a cheese centre of this type disclosed in DE-A-2 062 520/U.S. Pat. No. 3 753 534, in which the stiffening rings are identical and equidistant and the webs between two adjacent rings are identically formed but the webs in one row of webs between two adjacent rings are the mirror images of the webs in the adjacent row, there are no spacer lugs of the type disclosed, for example, in DE-U-7 516 449 (FIGS. 5 and 6) between two adjacent rings. The said spacer lugs disclosed in the said DE-U 7 516 449 are designed to cooperate in pairs to prevent the stiffening rings, which are connected by S-shaped webs, from approaching each other so closely, when the cheese centre is compressed in the axial direction, that the radial openings in the cheese centre will virtually close up and thus prevent the passage of dyeing liquid. Consequently, as these pairs of spacers are absent from the known cheese centre mentioned above, axial compression of the centre is liable to cause fibres of the wound yarn or the wound textile thread to get clamped between the ring connecting web and a stiffening or end ring and thereby be damaged.

SUMMARY AND OBJECTS OF THE INVENTION

It is therefore an object of the present invention to provide a compressible cheese centre for dyeing purposes in which this disadvantage is avoided and which protects the material wound on to the centre for dyeing purposes when the centre is under axial compression.

In a cheese centre of the type defined above, this problem is solved according to the invention by the provision of a plurality of pairs of cooperating spacer lugs formed on the rings (stiffening rings and end rings), each of these pairs of spacers being arranged between two ring connecting webs which are adjacent to one another in the circumferential direction, and between two adjacent rings so that the two spacers of each pair meet each other in the axial direction when the said adjacent rings approach one another.

In the cheese centre disclosed in DE-U-7 516 449 (FIGS. 5 and 6), similar spacers are provided between the rings but the two spacers of each pair are arranged in axial alignment in front of and behind a ring connecting web so that the two spacers of a pair strike with their entire contact surfaces, which are parallel to one another and set obliquely to the longitudinal axis of the cheese centre, against the non-axially extending middle section (main section) of the associated connecting web, one from each side of the web on axially opposite sides thereof. This action of the spacers against the ring connecting webs is said to stabilize the webs when the cheese centre is in the compressed state.

The cheese centre according to the present invention, on the other hand, has the advantage of safely preventing any part of a ring connecting web from making contact with the adjacent stiffening ring in the event of excessive axial compression of the cheese centre. Such contact could not only cause clamping of the fibres but could also lead to breakage of the ring connecting webs, especially if they are of the known type of hook-shaped webs.

In a preferred embodiment of the cheese centre according to the invention there is a clear radial distance between the spacer lugs and the envelope so that there will be no risk of fibres getting clamped between two lugs in contact with one another.

Also in the preferred embodiment, the spacer lugs of each pair are staggered in relation to one another in the circumferential direction by such an amount that when the cheese centre is under torsion due to compression, the lugs will make contact with one another in a direction parallel to the axis. This arrangement of the lugs of a pair, which are not spread out in the circumferential direction, obviates the spreading out of the lugs which would be necessary to ensure that the lugs meet and support one another if they were situated axially opposite one another and which would have the undesirable effect of reducing the size of the opening in the cheese centre.

Further in the preferred embodiment, one of several identical groups, each consisting of at least two ring connecting webs, is arranged in the circumferential direction between every two adjacent pairs of spacer lugs, the said connecting webs having the same distance apart in all the groups. This not only ensures the periodicity of the elements of the cheese centre in the circumferential direction but also obviates the need to provide pairs of spacer lugs between every two ring connecting webs adjacent to one another in the circumferential direction.

Lastly, in the preferred embodiment, adjacent end sections of two ring connecting webs provided one on each side of the same stiffening ring are staggered in relation to one another in the circumferential direction. By contrast, this staggered arrangement is not provided in the two known types of cheese centres and consequently the axial rigidity of the cheese centres is not uniformly distributed over the circumference of these known centres.

In the preferred embodiment of the cheese centre according to the invention with hook shaped ring connecting webs, the cross-sections of these identical webs taken transversely to their longitudinal direction are rectangular surfaces of equal area which have a greater dimension in the radial direction than in the direction parallel to the axis and in the circumferential direction. This known arrangement of the rectangular cross-sectional areas provides particularly great strength of the cheese centre in the radial direction, which is highly desirable on account of the centripetal internal pressure exerted on the cheese centre by the package wound on it.

In the preferred embodiment, the end sections of the hook shaped ring connecting webs, which end sections extend parallel to the axis, are approximately equal in length to the middle section of the webs. With this form of web, which in the extreme case results in the web being enclosed in a square such that the end sections of the web lie on two parallel sides of the square while the middle section of the web lies on the midline of the square, the strength of the cheese centre in the axial direction and the distance between the stiffening rings are both at an optimum, provided a sufficient number of ring connecting webs are situated between the adjacent stiffening rings of each section of the cheese centre, as is the case in the constructional example of the invention described below.

BRIEF DESCRIPTION OF THE DRAWINGS

The invention will now be described in detail with reference to the preferred embodiment of the compressible cheese centre according to the invention illustrated by way of example in the drawing, in which FIG. 2 is a surface view of the plane development of a section of this embodiment of the cheese centre, and FIG. 3 represents a section taken on the line III—III of FIG. 2 through a web and a lug of the embodiment.

DETAILED DESCRIPTION OF THE PREFERRED EMBODIMENT

Figure 1:
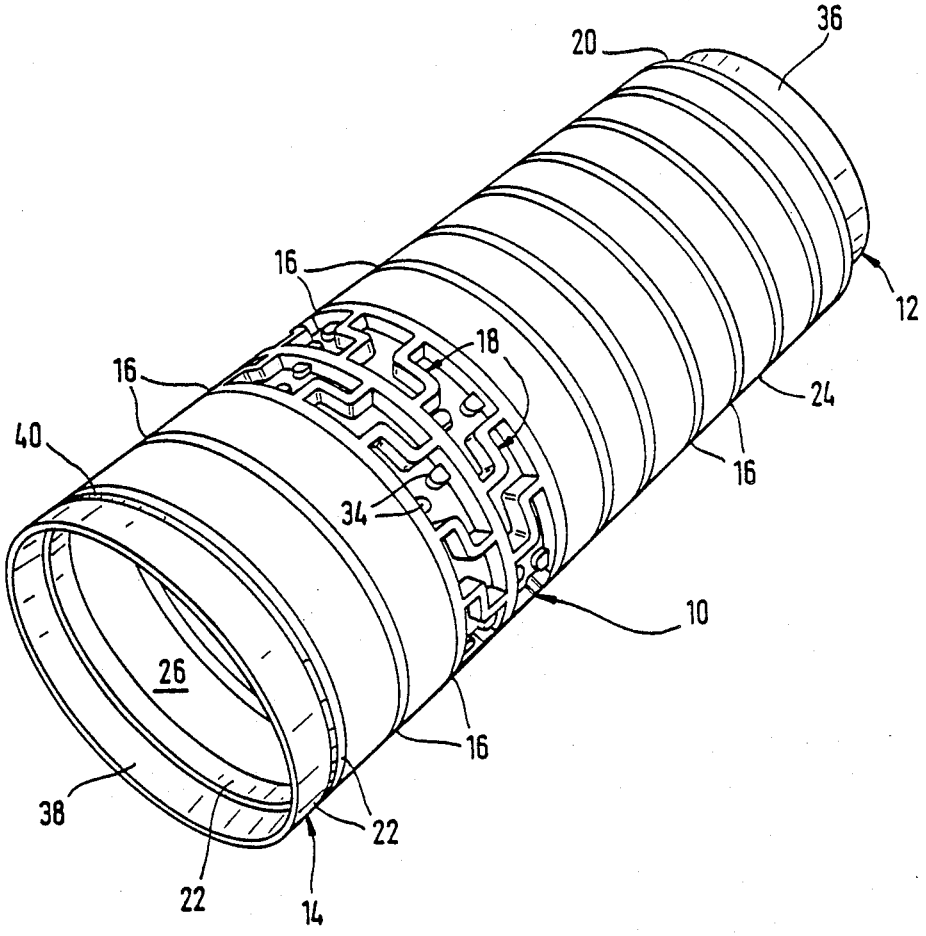
FIG. 1 is a perspective view of the embodiment with the webs and lugs omitted except in two subsections, in other words without any perforations shown in the central, main section.

In the preferred exemplary embodiment, the compressible cheese centre for dyeing purposes, which is fabricated of polypropylene, is substantially in the form of a circular cylindrical hollow body made in one piece comprising a long perforated middle section (10) and two relatively short end rings (12 and 14) which are complementary to one another in form so that two identical cheese centres can be plugged together in the axial direction.

The middle section (10) mainly comprises a plurality of identical stiffening rings (16) and a large number of ring connecting webs (18) which join two axially adjacent stiffening rings (16) together and each of which is connected at one end to a stiffening ring (16) and at its other end either to the adjacent stiffening ring (16) or to a web connecting section (20 or 22) of one of the end rings (12 and 14). The external surfaces of all the webs (18) and stiffening rings (16) and of the web connecting sections (20 and 22) of the end rings (12 and 14) form an external cylindrical envelope (24). Similarly, the internal surfaces of the above-mentioned parts of the cheese centre form a coaxial cylindrical envelope (26) in the interior of the cheese centre. The wall thickness of the middle section (10) is everywhere the same, i.e. the radial dimensions of the stiffening rings (16), the ring connecting webs (18) and the web connecting sections (20 and 22) of the end rings (12 and 14) are all the same. The axial width of the said stiffening rings (16) is, however, somewhat greater than the width of the ring connecting webs (18). This width of the connecting webs (18) is measured partly in the circumferential direction of the cheese centre and partly in its axial direction since the webs (18) are bent at right angles and connected to the rings (12,14 and 16) at right angles. The cross-sectional surface area of each web (18) is constant along the whole of its longitudinal line which is bent twice at an angle. The same applies to the stiffening rings (16), whose cross-sectional surfaces are rectangular in the planes of all the axial sections. The cross-sectional surfaces of the ring connecting webs (18) are also rectangular, both in all the radial sectional planes of the end sections (28) extending parallel to the axis and in all the axial sectional planes of the middle section (30) which extends in the circumferential direction and connects the two end sections. The middle section (30) of each web (18) is slightly longer than each of the two end sections (28) which are equal in length. When viewed in detail, each of these end sections (28) will be seen to be joined to the middle section (30) by way of an intermediate section (32) in the form of the quadrant of a circle in order to avoid indentation or the formation of a notch. The inner curvature (smaller radius of curvature) is also formed at the bases of the webs, where they join the rings (16 and 14 or 12). Several groups of ring connecting webs (18), each group composed of two webs (18) situated side by side in the circumferential direction, are arranged between every two adjacent rings (12,14 and 16). The two webs (18) of each group situated between the same two rings are arranged identically whereas the webs in each axially adjacent group are reversed so that the middle sections (30) in one group extend in the opposite circumferential direction to the middle sections of the webs in an axially adjacent group. Viewing the arrangements of connecting webs in the different sections of cheese centre extending from one stiffening ring (16) to the next or to an adjacent end ring (12 or 14), therefore, it will be seen that the arrangement alternates from one section to another in that, compared with the arrangement of the webs (18) in one section, the webs in the axially adjacent section are rotated about the longitudinal line of one of its two end sections (28) extending parallel to the axis.

The clear distance between two ring connecting webs (18) of the same group, which is approximately equal to the length of the middle sections(30) measured in the same circumferential direction, is smaller than the corresponding distance between one connecting web and the circumferentially adjacent web of the next group, so that the larger perforations in the cheese centre, which are situated between circumferentially adjacent webs belonging to different groups, are each large enough to accomodate a pair of cooperating spacer lugs (34). Each spacer lug (34) of a pair is joined to one of two axially adjacent rings (16, 14 or 12) in such a position that the two lugs of a pair are not in exact axial alignment although there is some overlap between them in the circumferential direction. The amount of shift between two spacer lugs (34) of a pair in the circumferential direction is calculated to ensure that the two lugs will correctly meet one another so that when pressure is applied to the cheese centre, the torsion produced between two successive stiffening rings (16) will not differ in amount but will change in sign from one section of the centre to the next.

The identical spacer lugs (34) are slightly wider than the ring connecting webs (18) in the circumferential direction but not as high as the webs in the radial direction, i.e. their radially inwardly facing broad side coincides with the internal envelope (26) but their radially outwardly facing side does not reach the outer envelope (24). While the two spacer lugs (34) of each pair in one and the same section of cheese centre are identically arranged, the arrangement alternates from one section of the cheese centre to the next so that the sign of the shift in position in the circumferential direction alternates.

The ring connecting webs (18) and the spacer lugs (34) are arranged to produce a periodicity in each section of the cheese centre so that identical pairs of webs and the pairs of lugs are uniformly distributed over the circumference of the centre and the arrangements recur in every second section. Whereas the number of webs and the number of lugs, which are the same in each section of the cheese centre and are inevitably equal to one another within a section, may be either even or odd, the number of sections should be even so that the total torsion of the compressed cheese centre between the two end rings (12 and 14) is theoretically zero.

In one end ring (12), the web connecting section (20), whose axial dimension is smaller than that of the stiffening rings (16), is followed by an end section (36) which forms the axially outer end of the cheese centre. The external surface of this end section (36), which is S-shaped or reverse S-shaped in profile, is situated radially more inwardly than the outer envelope (24), while its internal surface, which is in the form of a circular cylinder, forms part of the inner envelope (26). The other end ring (14), whose web connecting section (22) is wider in the axial direction than the stiffening rings (16), is accordingly followed by an outer end section (38) whose internal surface, which is correspondingly S-shaped or reverse S-shaped in profile, is radially external to the inner envelope (26), while its external surface, which is in the form of a circular cylinder, forms part of the outer envelope (24); and a groove forming a yarn or thread reserve (40) on the web connecting section (22) has its base on a smaller circumference than this outer envelope.

Several cheese centres described by way of example are fitted together in the axial direction so that they are locked together pairwise by their sections (36 and 38) in a form locking manner both in the axial and in the radial direction. When the packages mounted on the cheese centres are in the process of being dyed, a perforated spindle which has the external form of a circular cylinder equal in diameter to the internal envelope (26) of the cheese centres extends through the row of centres. When axial pressure is exerted on the free ends of the first and last cheese centre, all the cheese centres undergo axial compression so that the internal right angles of the ring connecting webs (18) are reduced and this compression may be continued until the paired spacer lugs (34) strike against one another.

What is claimed is:

1. A cylindrical, axially compressible cheese center for dyeing textile material on the center, comprising:

first and second end rings;

a plurality of stiffening rings arranged in axial succession between said first and second end rings;

each of said stiffening rings being firmly connected to an adjacent stiffening ring, with one of said stiffening rings being firmly connected to one of each of said first and second end rings, so that each of said stiffening rings is adjacent another ring;

said connections being made by a plurality of springy ring connecting webs arranged in a plurality of circumferential rows between said stiffening rings and said end rings;

said webs being bent at right angles and connected to said rings at right angles; and a plurality of pairs of cooperating spacer lugs formed on adjacent rings and situated in each case between two ring connecting webs which are adjacent to one another in the circumferential row between said rings; wherein said two spacer lugs of each pair of cooperating spacer lugs contact each other in the axial direction when said cheese center is axially compressed.

2. The cheese center of claim 1 wherein said stiffening rings, said connecting webs, and said spacer lugs have an external surface, said external surfaces of said stiffening rings and connecting webs forming a cylindrical envelope, and wherein a clear radial distance is formed between said envelope and the external surfaces of said lugs.

3. The cheese center according to claim 2, wherein the spacer lugs of each pair of lugs are staggered in relation to one another in the circumferential direction by such an amount that when the cheese center is under torsion due to compression, the lugs meet in a direction parallel to the axis.

4. The cheese center according to claim 3, wherein one of several identical groups of at least two ring connecting webs is arranged in the circumferential direction between every two adjacent pairs of spacer lugs, the said ring connecting webs being the same distance apart from one another in every group.

5. The cheese center according to claim 4, wherein adjacent end sections of two ring connecting webs formed on opposite sides of one and the same stiffening ring are staggered in relation to one another in the circumferential direction.

6. The cheese center according to claim 1, wherein the spacer lugs of each pair of lugs are staggered in relation to one another in the circumferential direction by such an amount that when the cheese center is under torsion due to compression, the lugs meet in a direction parallel to the axis.

7. The cheese center according to claim 1, wherein one of several identical groups of at least two ring connecting webs is arranged in the circumferential direction between every two adjacent pairs of spacer lugs, the said ring connecting webs being the same distance apart from one another in every group.

8. The cheese center according to claim 6, wherein adjacent end sections of two ring connecting webs formed on opposite sides of one and the same stiffening ring are staggered in relation to one another in the circumferential direction.

9. The cheese center according to claim 1, wherein said stiffening rings are arranged equidistantly from one another along said axial succession.

10. The cheese center according to claim 1, wherein said stiffening rings are identical with one another.

11. The cheese center of claim 1, wherein all the connecting webs between two adjacent rings are identical in form between said both adjacent rings.

12. The cheese center of claim 1, wherein all the connecting webs between two adjacent rings are mirror image in formation to all the connecting webs between one of said both adjacent rings and a ring adjacent to said one of said both adjacent rings.

13. A cylindrical, axially compressible cheese center for dyeing textile material on the center, comprising:

first and second end rings;

a plurality of stiffening rings arranged in axial succession between said first and second end rings;

each of said stiffening rings being firmly connected to an adjacent stiffening ring, with one of said stiffening rings being firmly connected to one of each of said first and second end rings, so that each of said stiffening rings is adjacent another ring;

said connections being made by a plurality of springy ring connection webs arranged in several circumferential rows between said stiffening rings and said end rings; and a plurality of pairs of cooperating spacer lugs formed on adjacent rings and situated in each case between two ring connecting webs which are adjacent to one another in the circumferential row between said rings; wherein said two spacer lugs of each pair of cooperating spacer lugs contact each other in the axial direction when said cheese center is axially compressed.

14. The cheese center of claim 13, wherein all the connecting webs between two adjacent rings are identical in form between said both adjacent rings.

15. The cheese center of claim 13, wherein all the connecting webs between two adjacent rings are mirror image in formation to all the connecting webs between one of said both adjacent rings and a ring adjacent to said one of said both adjacent rings.

16. The cheese center of claim 13 wherein said stiffening rings, said connecting webs, and said spacer lugs have an external surface, said external surfaces of said stiffening rings and connecting webs forming a cylindrical envelope, and wherein a clear radial distance is formed between said envelope and the external surfaces of said lugs.

17. The cheese center according to claim 13, wherein the spacer lugs of each pair of lugs are staggered in relation to one another in the circumferential direction by such an amount that when the cheese center is under torsion due to compression, the lugs meet in a direction parallel to the axis.

18. The cheese center according to claim 13, wherein one of several identical groups of at least two ring connecting webs is arranged in the circumferential direction between every two adjacent pairs of spacer lugs, the said ring connecting webs being the same distance apart from one another in every group.

19. The cheese center according to claim 13, wherein adjacent end sections of two ring connecting webs formed on opposite sides of one and the same stiffening ring are staggered in relation to one another in the circumferential direction.

20. The cheese center according to claim 13 wherein said stiffening rings are arranged equidistantly from one another along said axial succession.

21. The cheese center according to claim 13 wherein said stiffening rings are identical with one another.

* * * * *